US009643814B2

(12) United States Patent
Feffer

(10) Patent No.: US 9,643,814 B2
(45) Date of Patent: May 9, 2017

(54) UNIVERSAL WINDER

(71) Applicant: Mark Charles Feffer, Annapolis, MD (US)

(72) Inventor: Mark Charles Feffer, Annapolis, MD (US)

( * ) Notice: Subject to any disclaimer, the term of this patent is extended or adjusted under 35 U.S.C. 154(b) by 304 days.

(21) Appl. No.: 14/453,344

(22) Filed: Aug. 6, 2014

(65) Prior Publication Data

US 2016/0039631 A1 Feb. 11, 2016

(51) Int. Cl.

| | |
|---|---|
| ***B65H 75/30*** | (2006.01) |
| ***B65H 75/44*** | (2006.01) |
| ***B65H 75/40*** | (2006.01) |
| ***B65H 75/48*** | (2006.01) |
| ***B65H 54/10*** | (2006.01) |
| ***B65H 54/74*** | (2006.01) |

(52) U.S. Cl.

CPC ..... *B65H 75/30* (2013.01); *B65H 54/106* (2013.01); *B65H 54/74* (2013.01); *B65H 75/406* (2013.01); *B65H 75/4444* (2013.01); *B65H 75/4494* (2013.01); *B65H 75/486* (2013.01); *B65H 2402/412* (2013.01)

(58) Field of Classification Search

CPC .. B65H 75/30; B65H 75/406; B65H 75/4444; B65H 75/4492; B65H 75/4494; B65H 75/486; B65H 54/74; B65H 54/106; B65H 2402/412

USPC ..... 242/381.6

See application file for complete search history.

(56) References Cited

U.S. PATENT DOCUMENTS

| | | | | |
|---|---|---|---|---|
| 2,340,892 | A | 2/1944 | Maynes | |
| 2,573,456 | A | 10/1951 | Kutzler et al. | |
| 3,484,979 | A * | 12/1969 | Wonsch | A63H 27/002 224/103 |
| 4,130,122 | A | 12/1978 | Kennedy | |
| 5,868,334 | A * | 2/1999 | Cedillo | B65H 75/406 206/420 |
| 6,398,147 | B1 | 6/2002 | Fredrickson | |
| 6,467,755 | B2 | 10/2002 | Reiley et al. | |
| 6,499,491 | B2 | 12/2002 | Kennedy et al. | |
| 6,648,262 | B1 | 11/2003 | Huffman | |
| 7,374,124 | B2 | 5/2008 | Engelsher | |
| 7,644,906 | B2 | 1/2010 | Rodrigue | |
| 8,047,461 | B1 | 11/2011 | Slawson | |

* cited by examiner

*Primary Examiner* — William E Dondero
(74) *Attorney, Agent, or Firm* — DLA Piper LLP US

(57) ABSTRACT

A winder may include a body, a spindle, and a manually actuated winding mechanism. The spindle may be coupled to the body and constructed and arranged to be rotatable with respect to the body and to be removably coupled to at least one spool. The manually actuated winding mechanism may be coupled to the spindle and constructed and arranged to rotate the spindle and the at least one spool.

15 Claims, 9 Drawing Sheets

100

UNIVERSAL WINDER

DETAILED DESCRIPTION OF SEVERAL EMBODIMENTS

Many long, slender, and flexible items, such as wire, rope, string, webbing, hose, cord, etc., are used every day for a variety of purposes. These items may be wound around a spool for neat and compact storage. The systems and methods described herein provide a universal winder which may be capable of winding any such item around spools of many different sizes. As described in greater detail below, a universal winder may be a hand-held and manually operated device which may allow a user to quickly and easily wind an item around a spool.

Figure 1:
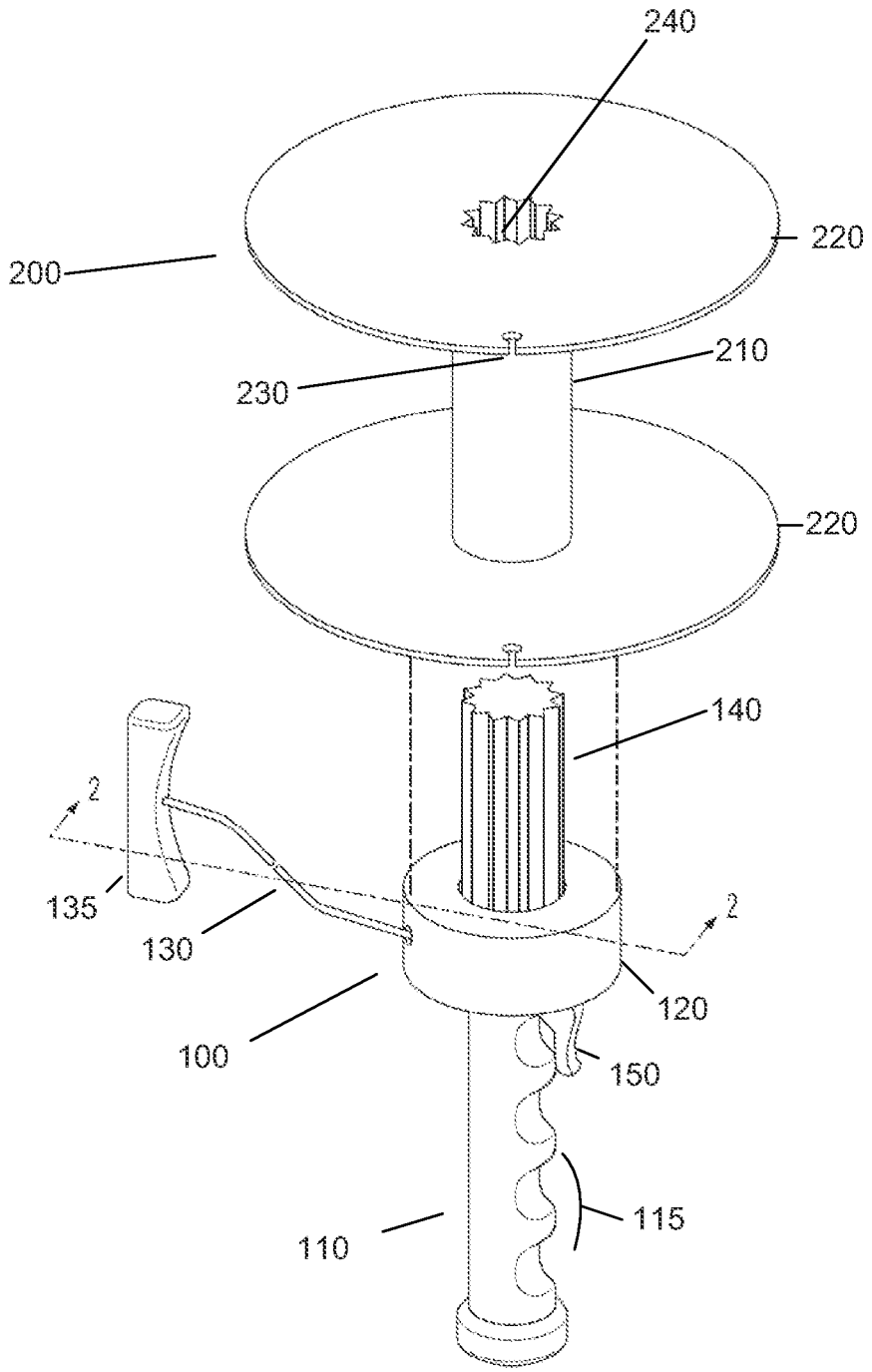
FIG. 1 is a perspective view of a winder and spool according to an embodiment of the invention.
Figure 3:
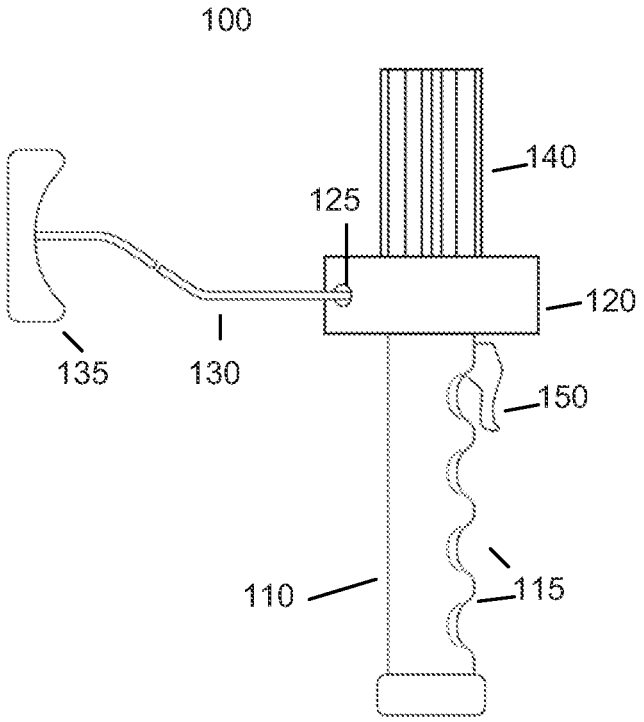
FIG. 3 is a side elevation view of a winder according to an embodiment of the invention.
Figure 4:
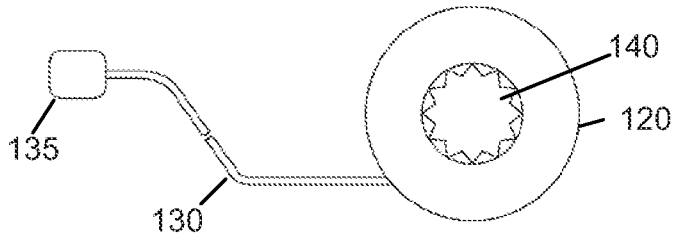
FIG. 4 is an overhead elevation view of a winder according to an embodiment of the invention.

FIG. 1 is a perspective view of a winder 100 and spool 200 according to an embodiment of the invention. FIG. 3 is a side elevation view of the winder 100, and FIG. 4 is an overhead elevation view of the winder 100. The winder 100 may include a handle 110 and enclosure 120, which may be regarded as a winder 100 body. In some embodiments, the handle 110 may include a grip surface 115 which may be configured to conform to a user's hand as shown. Other embodiments may have handles 110 with different shapes or designs. The enclosure 120 may house a cord 130 wound around the base of a spindle 140. The enclosure 120 may also house a coil spring 145, as illustrated in greater detail below. The cord 130 may exit the enclosure through a hole 125. The cord 130 may include a pull handle 135, which may be pulled by a user to unwind the cord 130 against spring pressure caused by unwinding the coil spring 145. Unwinding the cord in this manner may spin the spindle 140. The cord 130 may be allowed to retract in response to recoil pressure from coil spring 145. The enclosure 120 may be attached to or integrally formed with a handle 110. The winder 100 may also include a trigger 150. As described in greater detail below, actuating the trigger 150 may cause friction to slow or stop the rotation of spindle 140. In other embodiments, other devices (e.g., a button or switch) may be used in place of a trigger 150 and the location may be varied to accommodate thumb or forefinger actuation. Trigger 150 is show in a configuration accommodating forefinger actuation, although other placements may be possible.

The spool 200 may be used for winding items, such as wire, rope, string, webbing, hose, tubing, cord, and/or any other elongated and flexible object capable of being wound. In the following discussion, string is used as an example for ease of explanation. The spool 200 may include a shaft 210 and flanges 220. The shaft 210 may be partially or completely hollow, with an interior cavity 240 which may be shaped to fit onto the spindle 140 of the winder 100. In the example of FIG. 1, the spindle 140 and cavity 240 have corresponding star-shaped patterns. However, other patterns may be possible (e.g., square, hex, Phillips-shaped, etc.).

When the spool 200 is mounted on the spindle 140, rotating the spindle 140 (e.g., by pulling the cord 130) may cause the spindle 140, and thus the spool 200, to rotate. In other embodiments, the spool 200 may be attached to the spindle 140 in some other way, for example by locking or fastening in place. In some embodiments, the shaft 210 may be open on both ends, so that the spool 200 can be rotated 180 degrees and inserted on the spindle 140 in either direction. This may allow a user to both wind and unwind an item. A user may attach the string to the spool 200 (e.g., by tying it or wrapping it around the shaft 210, or by inserting in slots, holes, notches or other orifices of various sizes and shapes (not shown) in shaft 210 configured to anchor the end of items such as wire, rope, string, webbing, hose, tubing, cord etc. firmly to the shaft to allow winding to commence). In some embodiments, an individual spool 200 may include a plurality of orifices of different shapes and/or sizes, which may allow one spool 200 to accommodate a variety of items of different shapes and/or sizes. Spinning the spool 200 may cause the string to be wound around the shaft. The spool 200 may include flanges 220, for example one on each end of the shaft 210 as shown in the embodiment of FIG. 1. These flanges 220 may keep the string being wound from sliding off the shaft 210. One or more notches 230 may be formed in one or more of the flanges 220. The string may be inserted into a notch 230 after winding, which may keep an end of the string from unraveling off the spool 200. In some embodiments, an individual spool 200 may include a plurality of notches of different shapes and/or sizes, which may allow one spool 200 to accommodate a variety of items of different shapes and/or sizes. Many sizes and/or configurations of spool 200 may be provided to accommodate various items such as wire, rope, string, webbing, hose, tubing, cord, and/or any other elongated and flexible object capable of being wound. Each spool 200, regardless of size or configuration, may include an interior cavity 240 with a pattern corresponding to that of spindle 140, thereby making each spool 200 interchangeable and operable by a single winder 100.

Figure 2A:
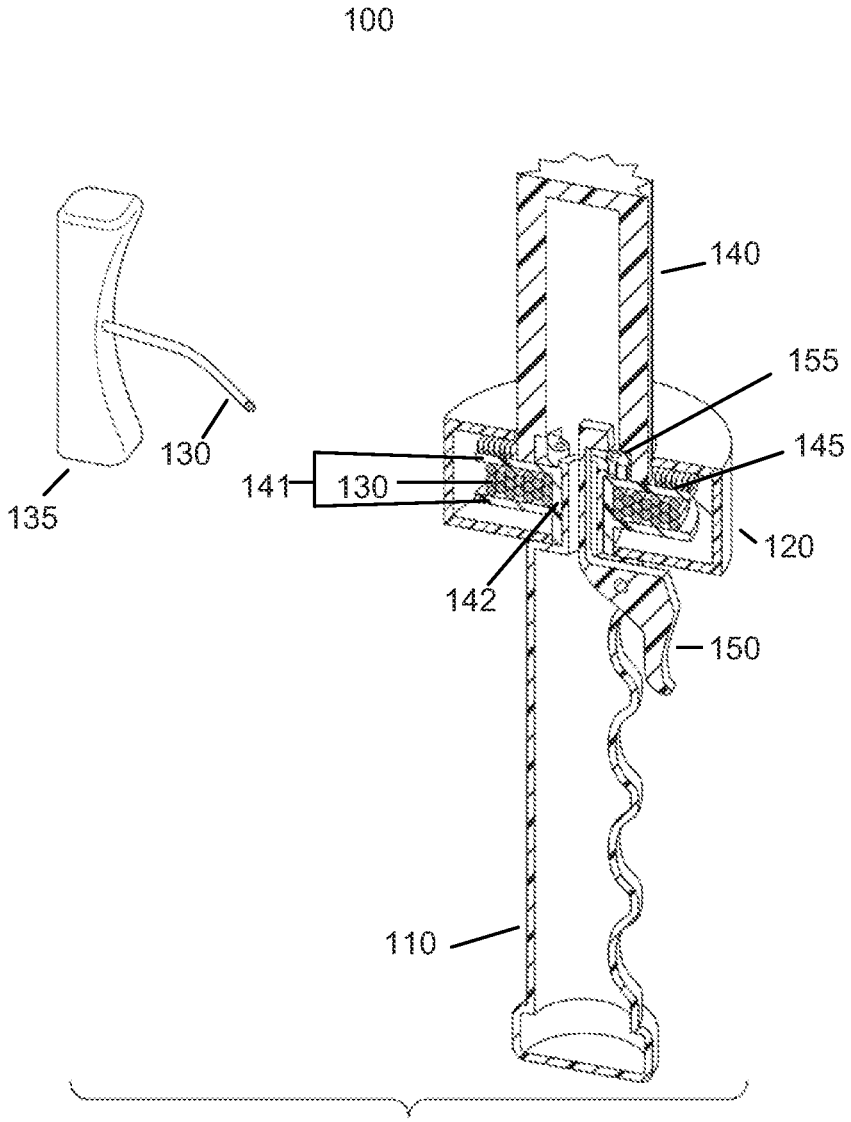
FIGS. 2A-2C are perspective cross-sections of a winder according to an embodiment of the invention.
Figure 5A:
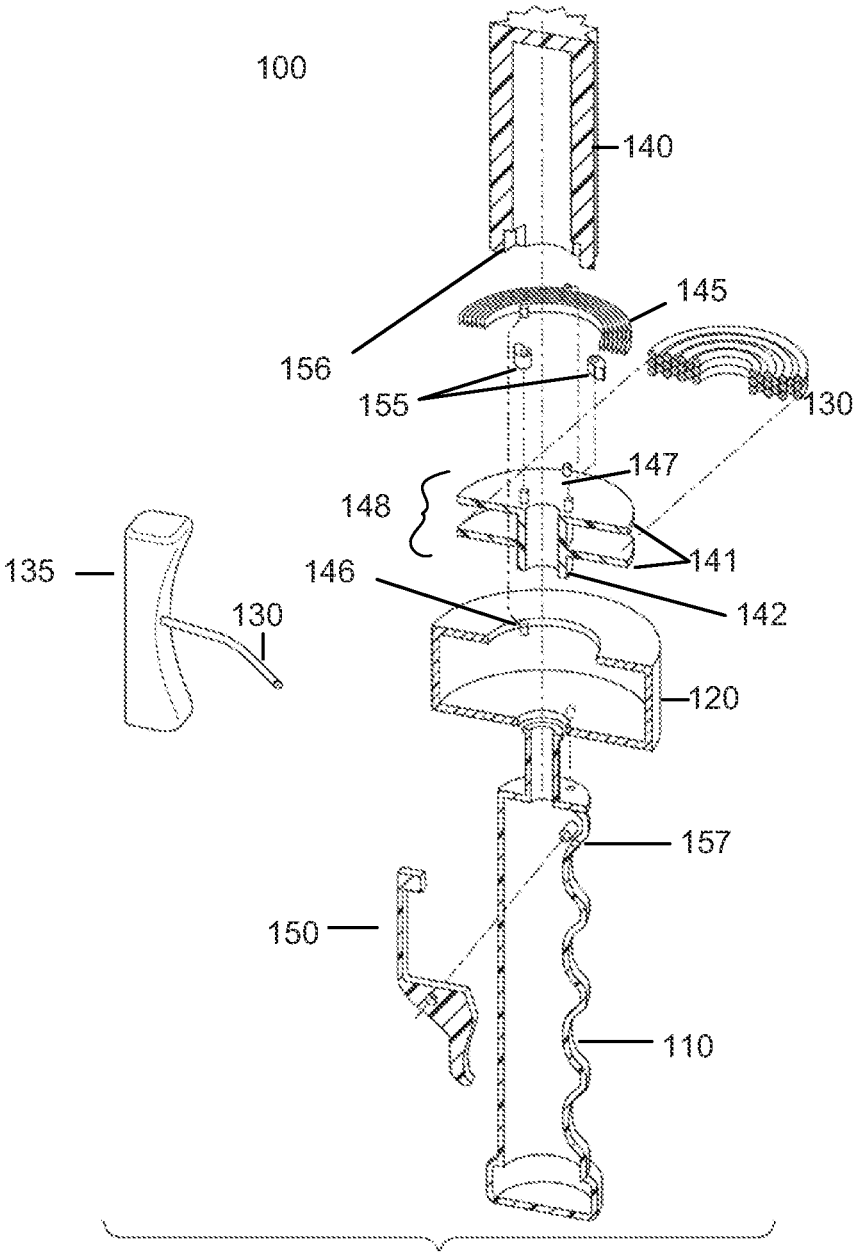
FIGS. 5A-5C are exploded perspective cross-sections of a winder according to an embodiment of the invention.

FIG. 2A is a perspective cross-section of a winder 100, taken along line 2 of FIG. 1, according to an embodiment of the invention. FIG. 5A is an exploded perspective cross-section of a winder 100, taken along line 2 of FIG. 1, according to an embodiment of the invention. In the example winder 100 shown, the handle 110 and spindle 140 are hollow, although either or both may be solid in other embodiments. Spindle 140 may be inserted into a spool 148 including a cylindrical shaft 142 with flanges 141. These flanges may keep pull cord 130 from sliding off the shaft 142 as it is wound around shaft 142 between the flanges 141. Two cam shaped actuators 155 may fit into notches 156 at the base of the interior of spindle 140 to form a clutch mechanism such that rotation of spindle 140 in one direction (which may be either clockwise or counter-clockwise) may engage the cam actuators 155 in notches 156 while allowing free rotation of spindle 140 in the opposite direction.

Figure 2B:
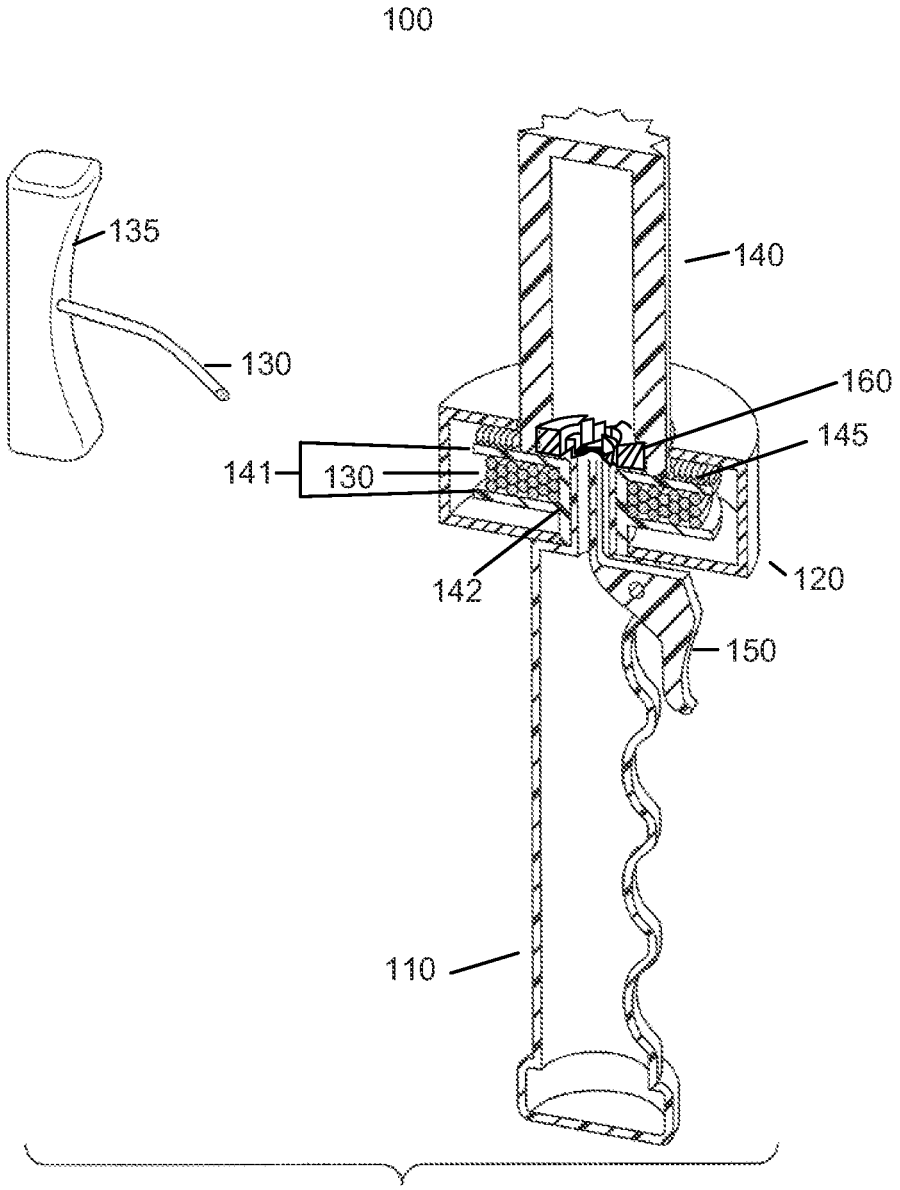
Figure 5B:
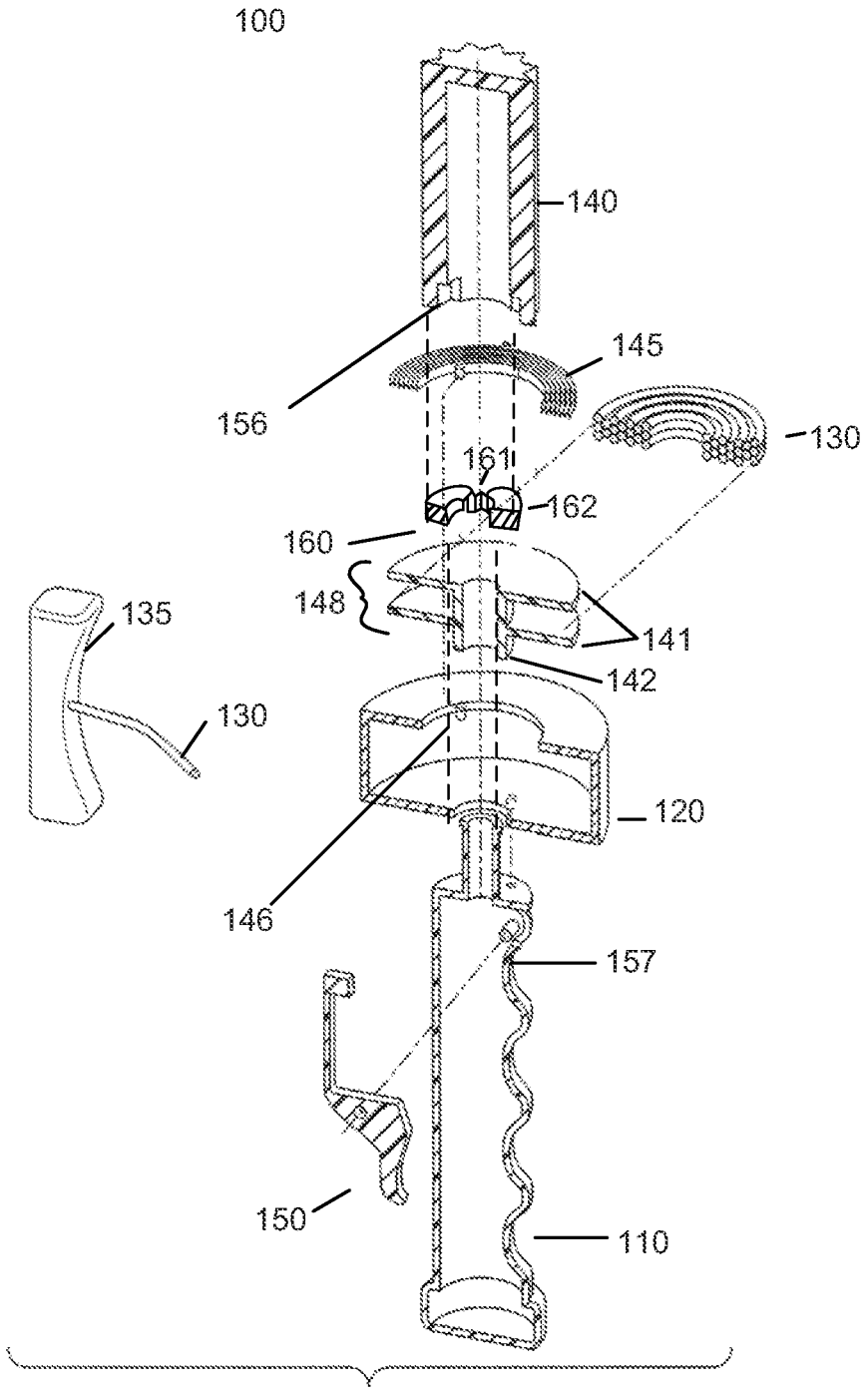

In other embodiments, a different clutch mechanism (e.g., plate clutch, centrifugal clutch, etc.) may be used. For example, FIG. 2B is a perspective cross-section of a winder 100 including a centrifugal clutch 160, taken along line 2 of FIG. 1, and FIG. 5B is an exploded perspective cross-section of a winder 100 including a centrifugal clutch 160, taken along line 2 of FIG. 1, according to an embodiment of the invention. The rotation of the spindle 140 in one direction (which may be either clockwise or counter-clockwise) may engage the clutch 160, for example by causing engagement of concentric shafts, one of which may be attached to (or may be formed by the interior of) the spindle 140, and the other of which may be attached to the enclosure 120.

Figure 2C:
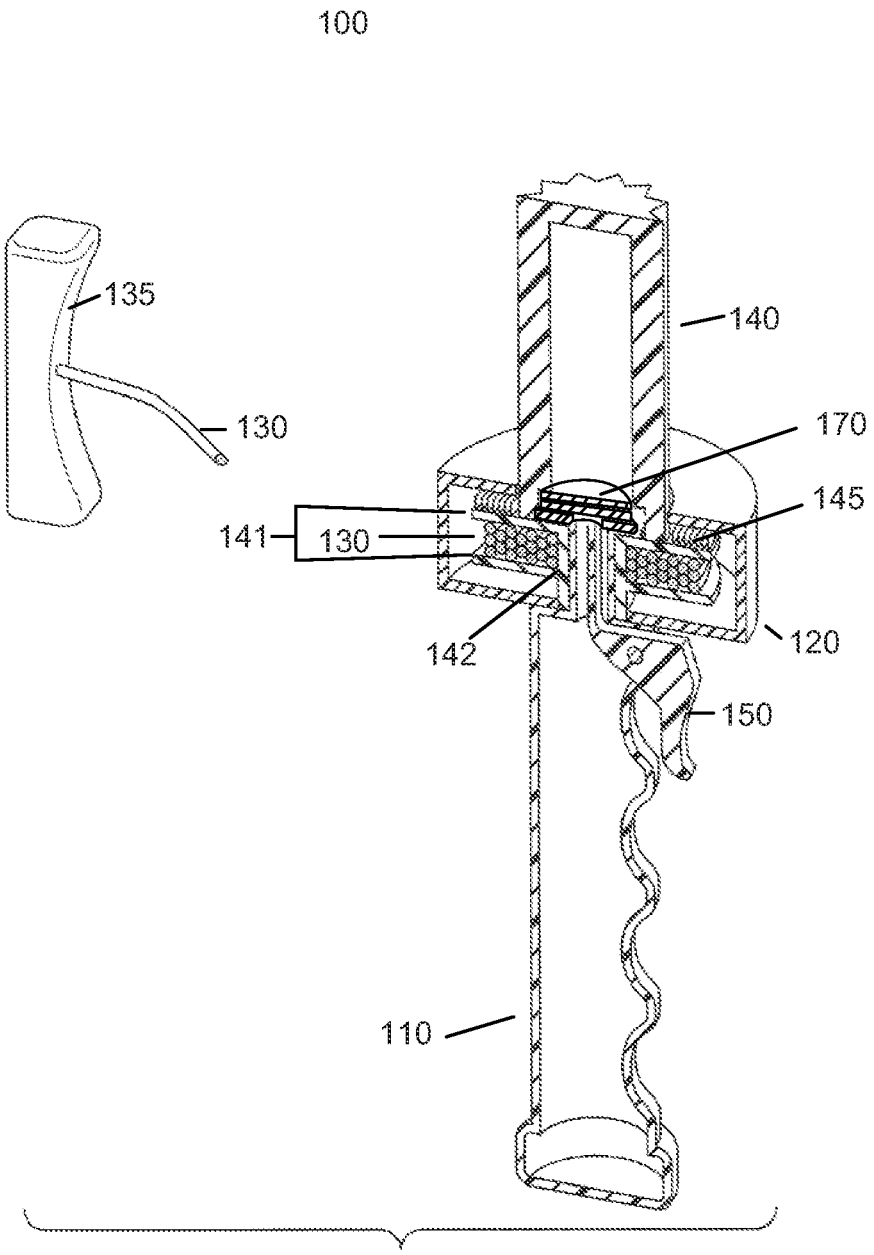
Figure 5C:
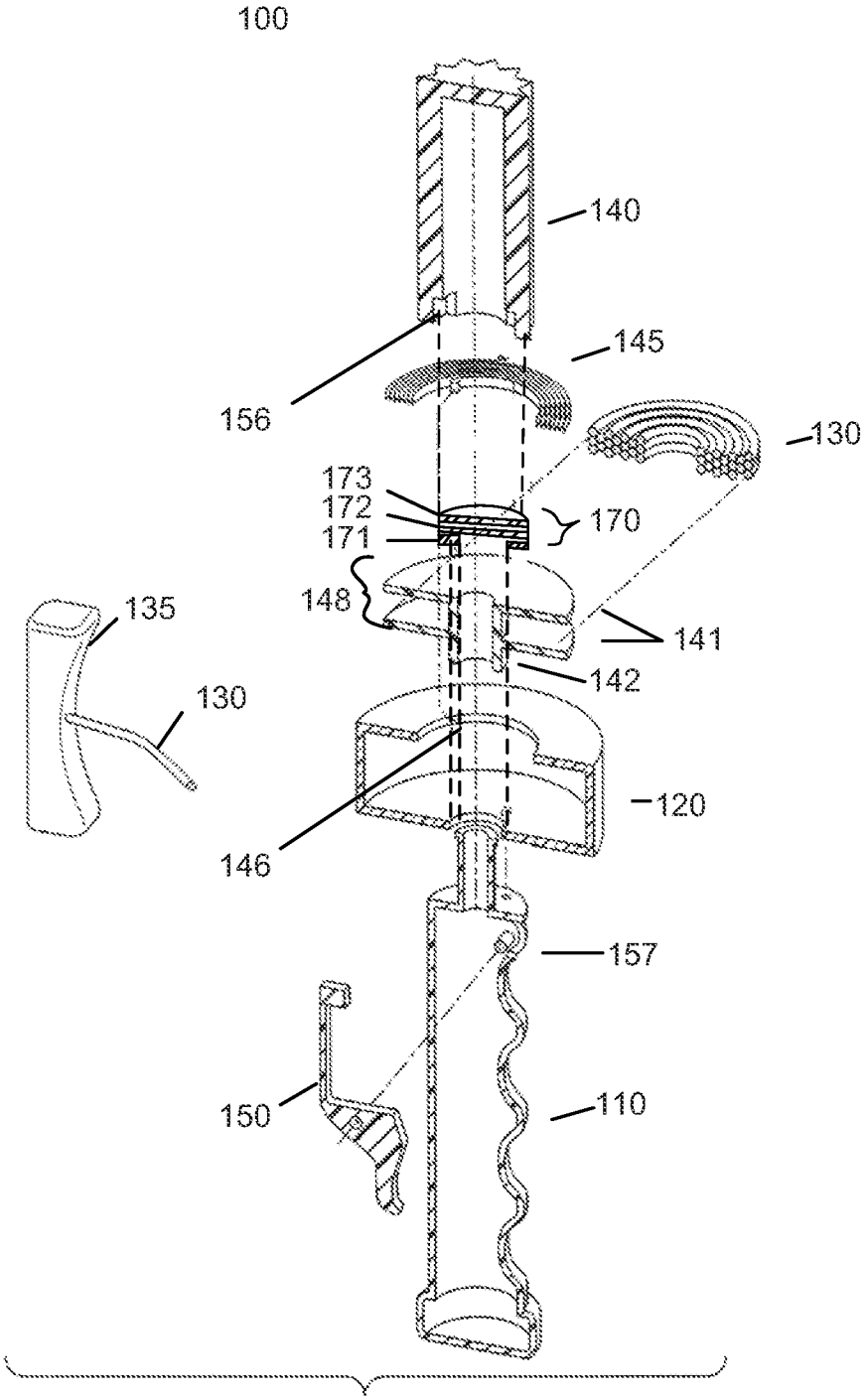

In another example, FIG. 2C is a perspective cross-section of a winder 100 including a plate clutch 170, taken along line 2 of FIG. 1, and FIG. 5C is an exploded perspective cross-section of a winder 100 including a plate clutch 170, taken along line 2 of FIG. 1, according to an embodiment of the invention. The rotation of the spindle 140 in one direction (which may be either clockwise or counter-clockwise) may engage the clutch 170, for example by causing plates to push together into engagement, one of which may be attached to the spindle 140, and the other of which may be attached to the enclosure 120.

Enclosure 120 may encase the spool 148, cam actuators 155 (or centrifugal clutch 160 or plate clutch 170), cord 130, and coil spring 145. One end of coil spring 145 may be affixed to the interior of enclosure 120 at a fixed point 146. The other end of coil spring 145 may be affixed to the flange 141 on the interior portion of spindle 140 at a fixed point 147. Coil spring 145 may be attached in a nearly relaxed state of tension, such that rotation of the spindle 140 may wind coil spring 145. Winding coil spring 145 may increase spring pressure by tightening the spring. Extraction of cord 130 by pulling pull handle 135 may cause the rotation of spool 148 in the direction that engages cam actuators 155 with notches 156 or engages the centrifugal clutch 160 or plate clutch 170, which may cause the simultaneous and equal rotation of spindle 140. If spindle 140 is engaged with spool 200 as described above, spindle 140 rotation may result in winding the intended item (wire, rope, string, webbing, hose, tubing, cord etc.). Extracting cord 130 may simultaneously tighten coil spring 145, which may increase spring tension. Subsequent release of the pull handle 135 may allow the release of spring pressure, and as the spool 148 rotates in the opposite direction of the rotation of spindle 140, the cam actuators 155 may disengage from notches 156, the centrifugal clutch 160 may disengage, or the plate clutch 170 may disengage, and allow the rewinding (i.e., retraction) of cord 130 while spindle 140 may continue to rotate and wind the intended item. One end of trigger 150 may extend outside enclosure 120 at a point easily actuated with the user's finger, as described above. Trigger 150 may be attached to handle 115 at a fulcrum point 157, and a portion of trigger 150 may extend into the interior of spindle 140 through the interior of spool 148 such that applying pressure on exterior portion of trigger 150 may cause the interior portion to make contact with the interior of spindle 140. This contact may cause friction to slow and/or stop the rotation of spindle 140. In other embodiments, trigger 150 may push in and pull out of handle 115 substantially linearly. When trigger 150 is pushed in, a portion of trigger 150 inside handle 115 may apply friction to spindle 140 to slow and/or stop the rotation of spindle 140. When trigger 150 is pulled out, spindle 140 may be able to rotate freely.

While various embodiments have been described above, it should be understood that they have been presented by way of example and not limitation. It will be apparent to persons skilled in the relevant art(s) that various changes in form and detail can be made therein without departing from the spirit and scope. In fact, after reading the above description, it will be apparent to one skilled in the relevant art(s) how to implement alternative embodiments. Thus, the present embodiments should not be limited by any of the above-described embodiments In addition, it should be understood that any figures which highlight the functionality and advantages are presented for example purposes only. The disclosed methodology and system are each sufficiently flexible and configurable such that they may be utilized in ways other than that shown.

Although the term "at least one" may often be used in the specification, claims and drawings, the terms "a", "an", "the", "said", etc. also signify "at least one" or "the at least one" in the specification, claims and drawings.

Finally, it is the applicant's intent that only claims that include the express language "means for" or "step for" be interpreted under 35 U.S.C. 112, paragraph 6. Claims that do not expressly include the phrase "means for" or "step for" are not to be interpreted under 35 U.S.C. 112, paragraph 6.

What is claimed is:

1. A winder comprising:

a body comprising a handle;

a spindle coupled to the body, the spindle constructed and arranged to be rotatable with respect to the body and to be removably coupled to at least one spool; and a manually actuated winding mechanism disposed within the handle and coupled to the spindle, the winding mechanism constructed and arranged to rotate the spindle and the at least one spool, the winding mechanism comprising:

a cord wound around the spindle, the cord being constructed and arranged so that pulling the cord causes the spindle to rotate with respect to the body, and a centrifugal clutch constructed and arranged to allow rotation of the spindle with respect to the body in one direction and allow retraction of the cord while the spindle is rotating in another direction.

2. The winder of claim 1, wherein the handle comprises an enclosure enclosing at least a portion of the winding mechanism.

3. The winder of claim 1, wherein the spindle comprises a shaft onto which the at least one spool is removably coupled, the shaft having a shape corresponding to a shape of an opening of the at least one spool.

4. The winder of claim 3, wherein the shape of the shaft and the shape of the opening of the at least one spool correspond to interlock so that the at least one spool is restricted from rotating with respect to the shaft.

5. The winder of claim 1, further comprising the at least one spool.

6. The winder of claim 5, wherein the at least one spool comprises an opening having a shape corresponding to a shape of the spindle.

7. The winder of claim 6, wherein the shape of the shaft and the shape of the opening of the at least one spool correspond to interlock so that the at least one spool is restricted from rotating with respect to the shaft.

8. The winder of claim 5, wherein the spool comprises at least one flange.

9. The winder of claim 5, wherein the spool comprises at least one anchoring point constructed and arranged to be removably coupled to at least one item to be wound.

10. The winder of claim 5, wherein the spool comprises at least one opening constructed and arranged to accept an end of at least one item wound around the spool.

11. The winder of claim 1, wherein the cord comprises a pull handle disposed at an end of the cord.

12. The winder of claim 1, wherein the winding mechanism further comprises a spring constructed and arranged to apply recoil pressure to the spindle that causes the cord to retract.

13. The winder of claim 1, wherein the winding mechanism comprises a brake constructed and arranged to slow or stop rotation of the spindle with respect to the body.

14. The winder of claim 13, wherein the winding mechanism further comprises a trigger coupled to the brake and constructed and arranged to operate the brake when actuated.

15. The winder of claim 1, wherein the winding mechanism is operable by a user to rotate the spindle and the at least one spool without the user manually manipulating the spindle and/or the at least one spool.

* * * * *